US007165524B2

(12) United States Patent
Amino

(10) Patent No.: US 7,165,524 B2
(45) Date of Patent: Jan. 23, 2007

(54) AIR CLEANER SUPPORTING STRUCTURE IN V-TYPE ENGINE

(75) Inventor: Hideo Amino, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 32 days.

(21) Appl. No.: 10/933,304

(22) Filed: Sep. 3, 2004

(65) Prior Publication Data

US 2005/0139184 A1 Jun. 30, 2005

(30) Foreign Application Priority Data

Sep. 10, 2003 (JP) ..... 2003-318297

(51) Int. Cl.
*F02M 35/10* (2006.01)

(52) U.S. Cl. ..... 123/184.31; 123/198 E

(58) Field of Classification Search ..... 123/184.31, 123/198 E, 193.1; 180/219, 291, 68.3; 55/385.3
See application file for complete search history.

(56) References Cited

U.S. PATENT DOCUMENTS 5,918,576 A * 7/1999 Ohoka et al. ..... 123/198 E

FOREIGN PATENT DOCUMENTS

JP 60-131317 A 7/1985

* cited by examiner

*Primary Examiner*—Stephen K. Cronin
*Assistant Examiner*—Hyder Ali
(74) *Attorney, Agent, or Firm*—Birch, Stewart, Kolasch & Birch, LLP

(57) ABSTRACT

To reduce the number of component parts for supporting an air cleaner and facilitate the assembly work of the air cleaner in a V-type engine having part of an air intake device including the air cleaner arranged between a pair of banks. The air cleaner arranged on the side of the two banks is supported by cleaner supporting units integrally provided in the cylinder blocks or the cylinder heads in the two banks.

15 Claims, 6 Drawing Sheets

AIR CLEANER SUPPORTING STRUCTURE IN V-TYPE ENGINE

CROSS-REFERENCE TO RELATED APPLICATIONS

The present application is related to Japanese Patent Application No. 2003-318297 filed on Sep. 10, 2003 the entire contents of which are hereby incorporated by reference.

BACKGROUND OF THE INVENTION

1. Field of the Invention

The present invention relates to a V-type engine having part of an air intake device including an air cleaner interposed between a pair of banks, more particularly, to an improvement of an air cleaner supporting structure.

2. Description of Background Art

As disclosed in Japanese Unexamined Publication No. Sho 60 (1985)-131317, an example of a V-type engine installed in a motorcycle is known in which an air cleaner is disposed on a side of the front bank of the two banks, and the air cleaner is supported by a supporting stay extending from a body frame.

When an air cleaner is supported by a supporting stay, as has been conventionally done, the number of component parts for supporting the air cleaner is increased.

SUMMARY AND OBJECTS OF THE INVENTION

Considering the above situation, it is an object of the present invention to provide an air cleaner supporting structure in a V-type engine which can reduce the number of component parts and facilitate the air cleaner installation.

In order to achieve the above-described object, the present invention provides a V-type engine having part of an air intake device including an air cleaner interposed between a pair of banks. The air cleaner is disposed on the side of the two banks and is supported by cleaner supporting units which are integrally provided in cylinder blocks or cylinder heads in the two banks.

In addition, the present invention provides an elastic member that is interposed between the cleaner supporting units and the air cleaner.

Further, the present invention provides collars which run through the elastic member attached to the air cleaner to abut on the cleaner supporting units that are provided with flanges which abut on the elastic members from the side of the cleaner supporting units. Washers are interposed between the enlarged head of the bolts which are inserted into the collars and screwed into the cleaner supporting units and the elastic member.

In addition, the present invention provides cleaner supporting units which are arranged in one location in each of the two banks that are arranged in the cylinder blocks or the cylinder heads.

According to the present invention, the air cleaner can directly be supported by the two banks of a V-type engine without using conventional supporting stays. Thus, the present invention allows a reduction in the number of component parts and facilitates the air cleaner installation.

Further, according to the present invention, the air cleaner does not resonate in harmony with engine vibrations. Thus, the vibrations of the air cleaner can be suppressed.

According to the present invention, the air cleaner can be securely fixed on the two banks of the engine while suppressing the air cleaner resonance.

According to the present invention, the air cleaner is supported at a total of three locations, that is, one location in each of the two banks and one location in the connecting part of the air cleaner to the two banks. Thus, the air cleaner can be firmly fixed against engine vibrations.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An aspect to carry out the present invention will be described below according to one embodiment of the present invention as shown in the accompanying drawings.

Figure 1:
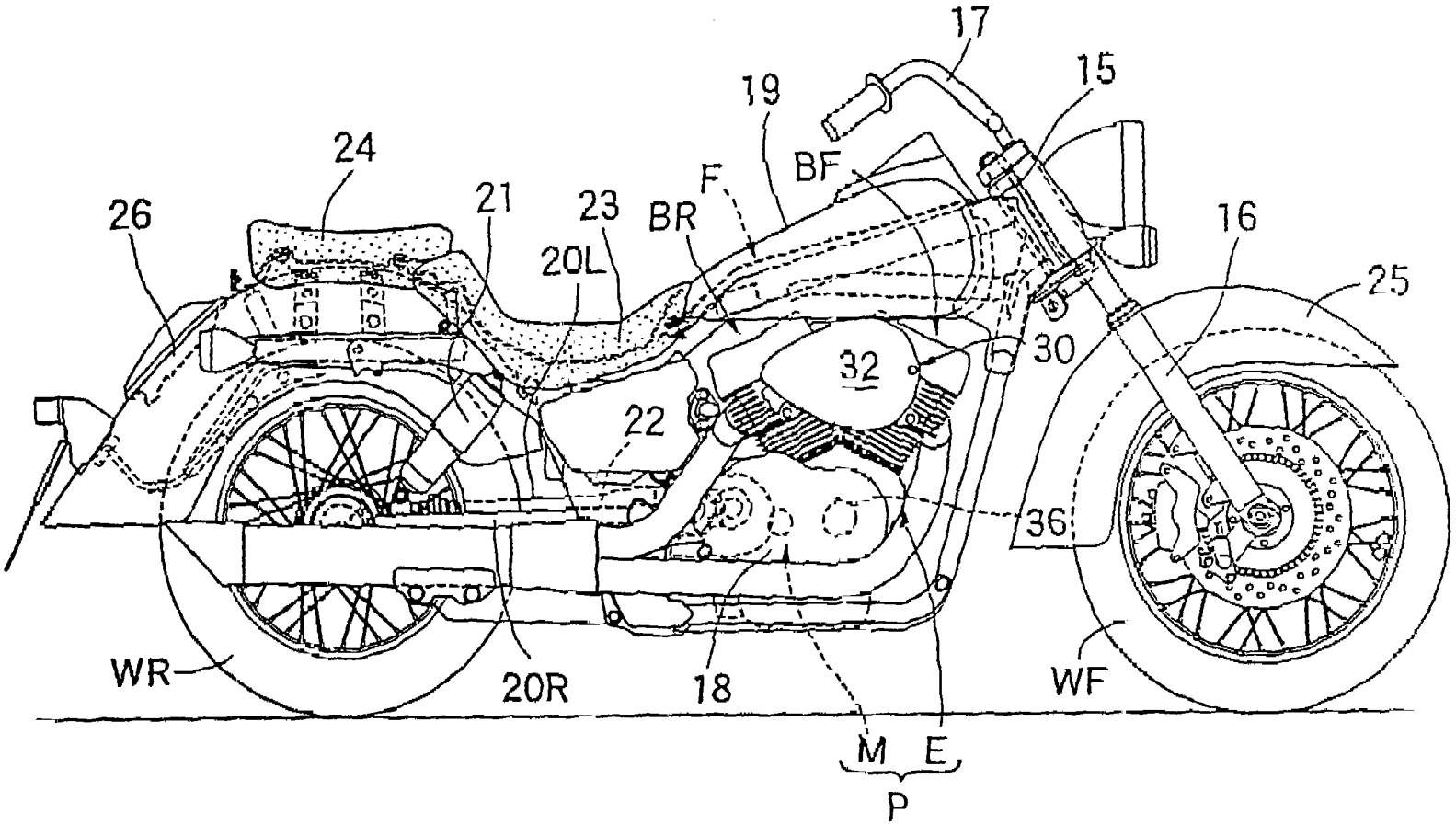
FIG. 1 is a side view of a motorcycle.

FIGS. 1 through 7 illustrate an embodiment according to the present invention. In FIG. 1, a body frame F of a motorcycle has at its front end a head pipe 15 by which a steerable front fork 16 is supported, the front fork 16 rotatably supports a front wheel WF. A steering handle 17 is connected to the front fork 16. In the forward part of the body frame F, a power unit P is mounted that includes an engine E and a transmission M contained in the crankcase 18 of the engine E. In addition, a fuel tank 19 is mounted in the forward part of the body frame F in a manner that the fuel tank 19 covers the engine E from above.

The front ends of a pair of swing arms 20L, 20R, which extend back and forth, are vertically shakably supported by the body frame behind the power unit P, and a rear wheel WR is rotatably supported between the rear ends of the swing arms 20L, 20R. Rear shock absorbers 21 . . . are interposed between the body frame F and the rear parts of the swing arms 20L, 20R, respectively. Of the two swing arms 20L, 20R, the left swing arm 20L is formed into a tubular shape. A drive shaft 22 for transmitting the driving power from the power unit P to the rear wheel WR is contained in the left swing arm 20L.

A main seat 23 for seating a rider is mounted to the body frame F behind the fuel tank 19 with a pillion seat 24 for a fellow passenger being mounted to the body frame F behind the main seat 23.

A front fender 25 covering the front wheel WF from above is attached to the front fork 16 and a rear fender 26 covering the rear wheel WR from above is attached to a rear part of the body frame F.

Figure 2:
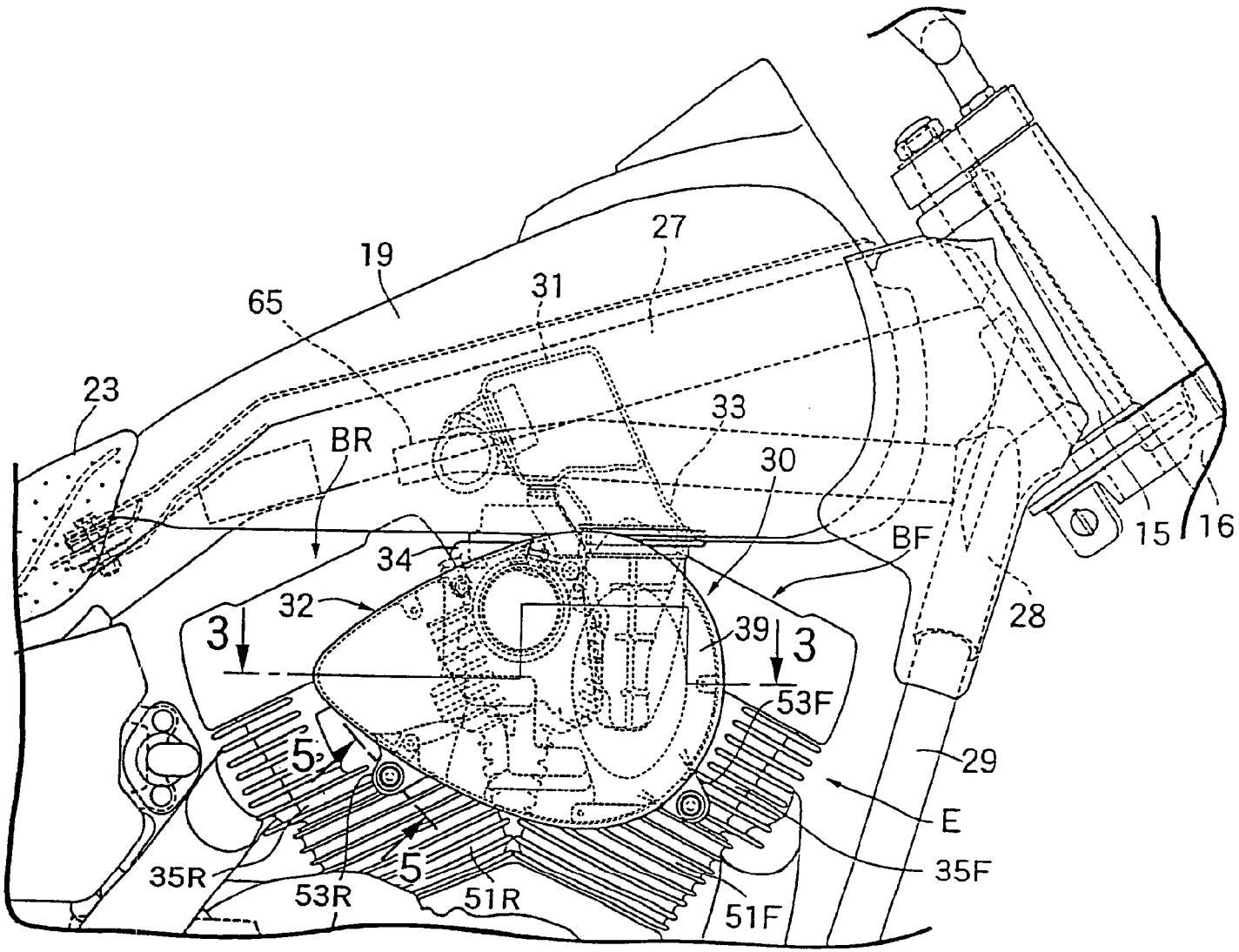
FIG. 2 is an enlarged fragmentary view of FIG. 1.

Referring to FIG. 2 together, the body frame F comprises a main pipe 27 which extends rearwardly and downwardly from the head pipe 15, a gusset 28 is welded to a lower part of the head pipe 15 and a down pipe 29 extends rearwardly and downwardly from the gusset 28 to support a lower part of the engine E. The fuel tank 19 is formed approximately into an inverted U-shape in a manner wherein it straddles the main pipe 27 from above. The engine E is disposed under the fuel tank 19, and is constructed into a V-type in which the front bank BF and the rear bank BR are so arranged as to form an approximate V-shape.

An air intake device 30 for the engine E includes an air intake chamber 31, an air cleaner 32, an air intake tube 33 which connects the air intake chamber 31 with the air cleaner 32 and a carburetor 34 which is connected to the air cleaner 31 so as to meter an air quantity to be supplied to cylinder heads 35F, 35R in the two banks BF, BR and to supply atomized fuel into the metered air. At least a part of the air intake device 30, that is, the air intake chamber 31, the air intake tube 33 and the carburetor 34 in this embodiment, is arranged between the two banks BF, BR so that it branches out and is connected to the cylinder heads 35F, 35R in the two banks BF, BR.

Figure 3:
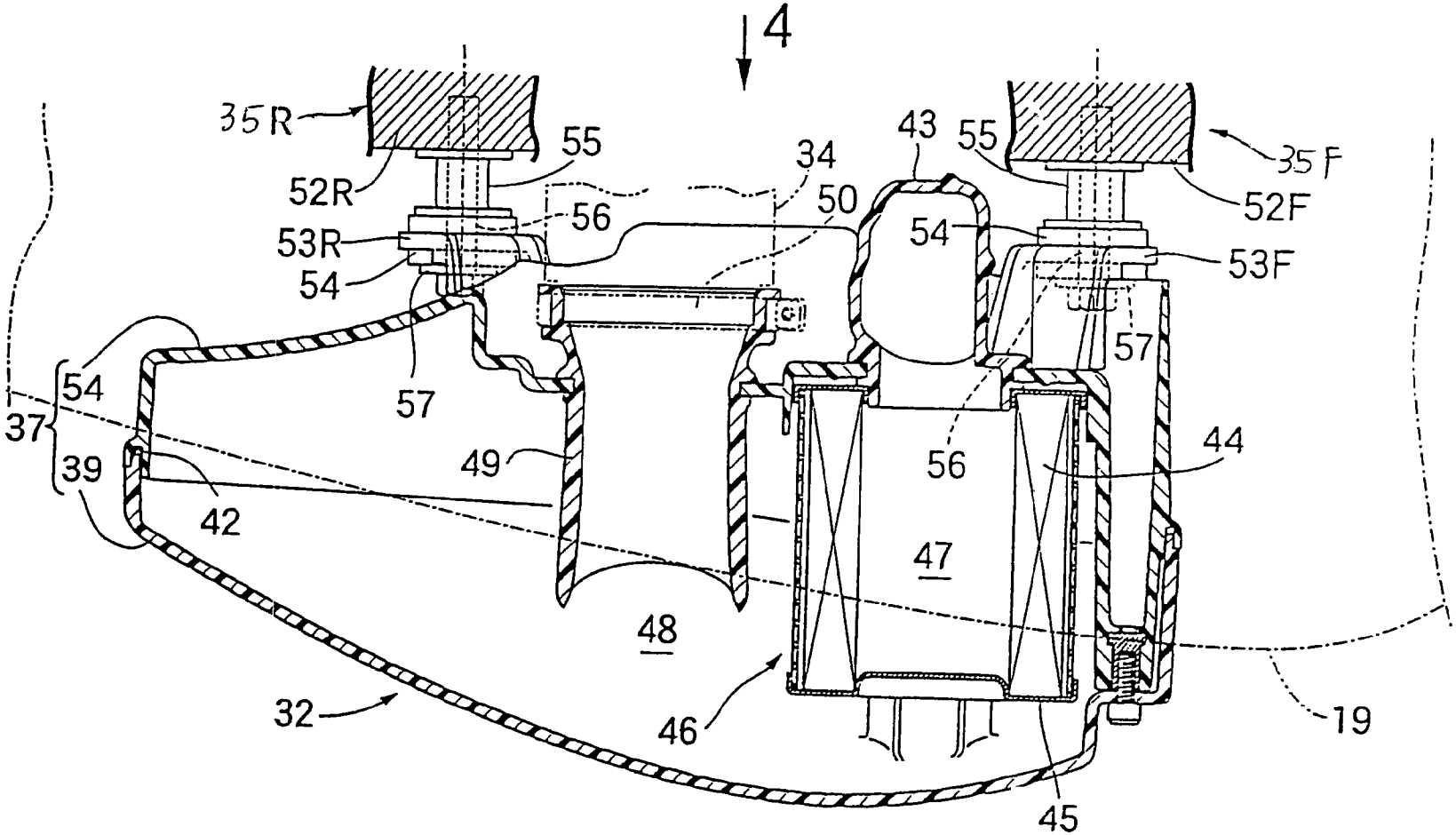
FIG. 3 is a cross sectional view taken along line 3—3 in FIG. 2.
Figure 4:
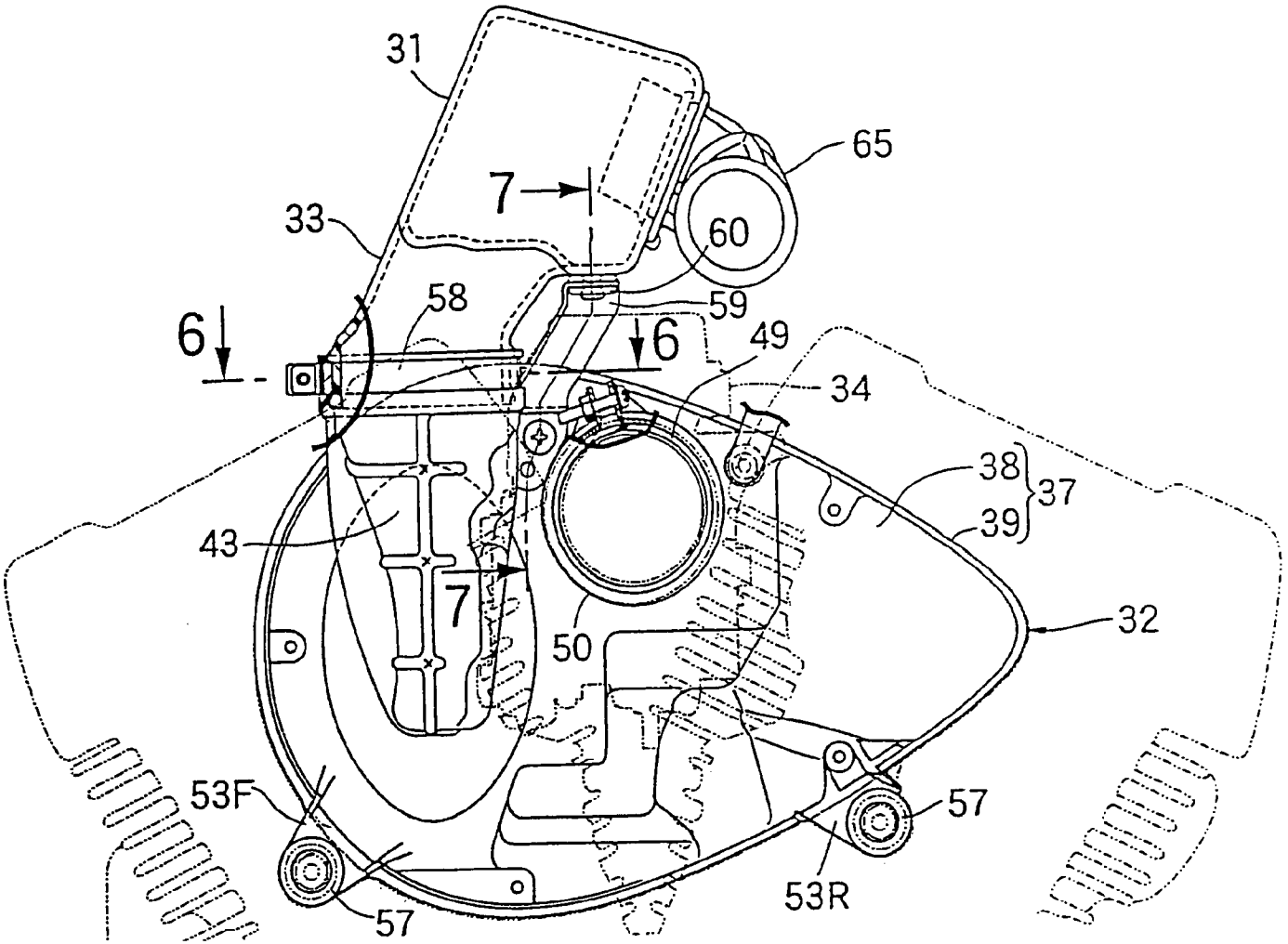
FIG. 4 is a cross sectional view in the direction of the arrow 4 in FIG. 3.

In FIG. 3 and FIG. 4, the air cleaner 32 is arranged on the right-hand side of the cylinder heads 35F, 35R in the two banks BF, BR so that the air cleaner 32 partly overlaps the two banks BF, BR in a side view seen in the axial direction of a crankshaft 36 (see FIG. 1) provided in the engine E.

An air cleaner case 37 for the air cleaner 32 includes an inner case half 38 arranged on the side of the cylinder heads 35F, 35R and an outer case half 39 arranged on the side opposite to the cylinder heads 35F, 35R with respect to the inner case half 38. The two case halves 38, 39 are joined with each other with a gasket 42 interposed between their rims by screwing and fastening screws 41 . . . which are inserted into points at which the outer case half 39 abuts on pairs of fastening bosses 40 . . . provided in the inner case half 38, into the fastening bosses 40.

An intake side connecting tube 43 extends upwardly along the front outer face of the inner case half 38 of the cleaner case 37 and is arranged on the inboard side of the cleaner case 37. The lower end of the intake side connecting tube 43, which is bent approximately at right angle, is fitted and connected to a front part of the outer case half 39. Further, a cleaner unit 46 is formed by attaching a cylindrical cleaner element 44 to an element case 45 and is fitted inside the cleaner case 37 between the lower end of the intake side connecting tube 43 and the outer case half 39. Thus, the space inside the cleaner case 37 is divided into an unfiltered chamber 47 which is so formed inside the cleaner unit 46 so as to communicate with the intake side connecting tube 43 and a filtered chamber 48 formed outside the cleaner unit 46.

In the inner case half 38 of the cleaner case 37, an outlet side connecting tube 49 located behind the intake side connecting tube 43 is fitted and connected to the filtered chamber 48 with its one end protruding into the filtered chamber 48. The carburetor 34 is fitted and connected to the other end of the outlet side connecting tube 49. Thus, the connection of the carburetor 34 to the outlet side connecting tube 49 is maintained by fastening a fastening band 50.

Each cleaner supporting unit 52F, 52R is integrally provided in one location in each of cylinder blocks 51F, 51R or the cylinder heads 35F, 35R in the two banks BF, BR (the cylinder heads 35F, 35R in the case of this embodiment).

On the other hand, the inner case half 38 of the cleaner case 37 is provided with a pair of mounting arms 53F, 53R which correspond to the cleaner supporting units 52F, 52R, respectively. These mounting arms 53F, 53R are supported by the cleaner supporting units 52F, 52R through grommets 54, 54 which are elastic members. That is, the air cleaner 32 is supported through the grommets 54, 54 by the air cleaner supporting units 52F, 52R which are integrally provided in one location in each of the cylinder heads 35F, 35R in the two banks BF, BR.

Figure 5:
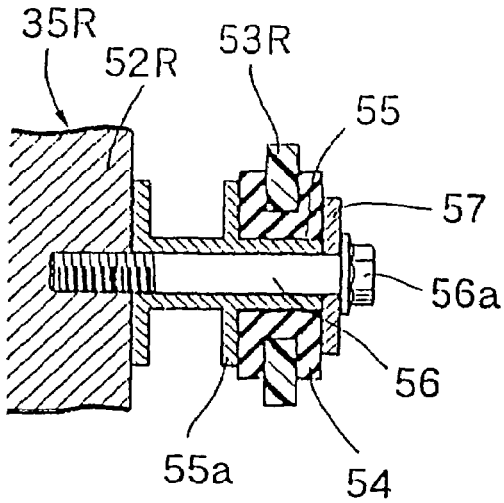
FIG. 5 is an enlarged cross sectional view taken along line 5—5 in FIG. 2.

In FIG. 5, a collar 55, runs through the grommet 54 fitted to the mounting arm 53R for the air cleaner 32 to abut on the cleaner supporting unit 52R at its one end. The collar 55 is provided with a flange 55*a* which abuts on the grommet 54 from the side of the cleaner supporting unit 52R. A washer 57 is interposed between an enlarged head 56*a* of a bolt 56, which is inserted into the collar 55 and screwed into the cleaner supporting unit 52R, and the grommet 54.

As is the case with the supporting structure of the mounting arm 53R to the cleaner supporting unit 52R, the mounting arm 53F for the air cleaner 32 is attached to the cleaner supporting unit 52F by using the grommet 54, the collar 55 and the washer 57.

Figure 6:
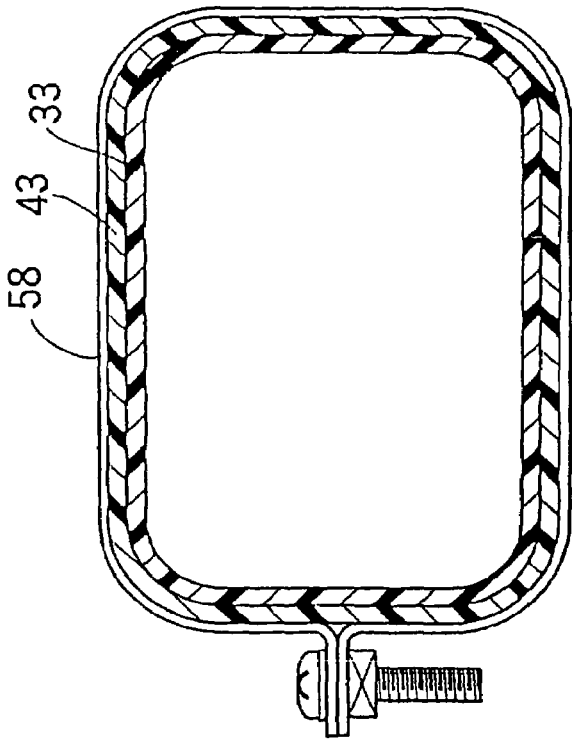
FIG. 6 is a cross sectional view taken along line 6—6 in FIG. 4.

As illustrated in FIG. 4, the air intake tube 33 and the air intake chamber 31 are integrally formed with a synthetic resin. The air intake tube 33 and the intake side connecting tube 43, which is connected to the air intake tube 33, are configured so as to have a square or rectangular cross section, as shown in FIG. 6. In order to compactly construct the connecting part of the intake side connecting tube 43 to the air cleaner 32 the lower end is bent nearly at a right angle. The fitting and connection part of the air intake tube and the air intake side connecting tube 43 is fastened with the fastening band 58.

Figure 7:
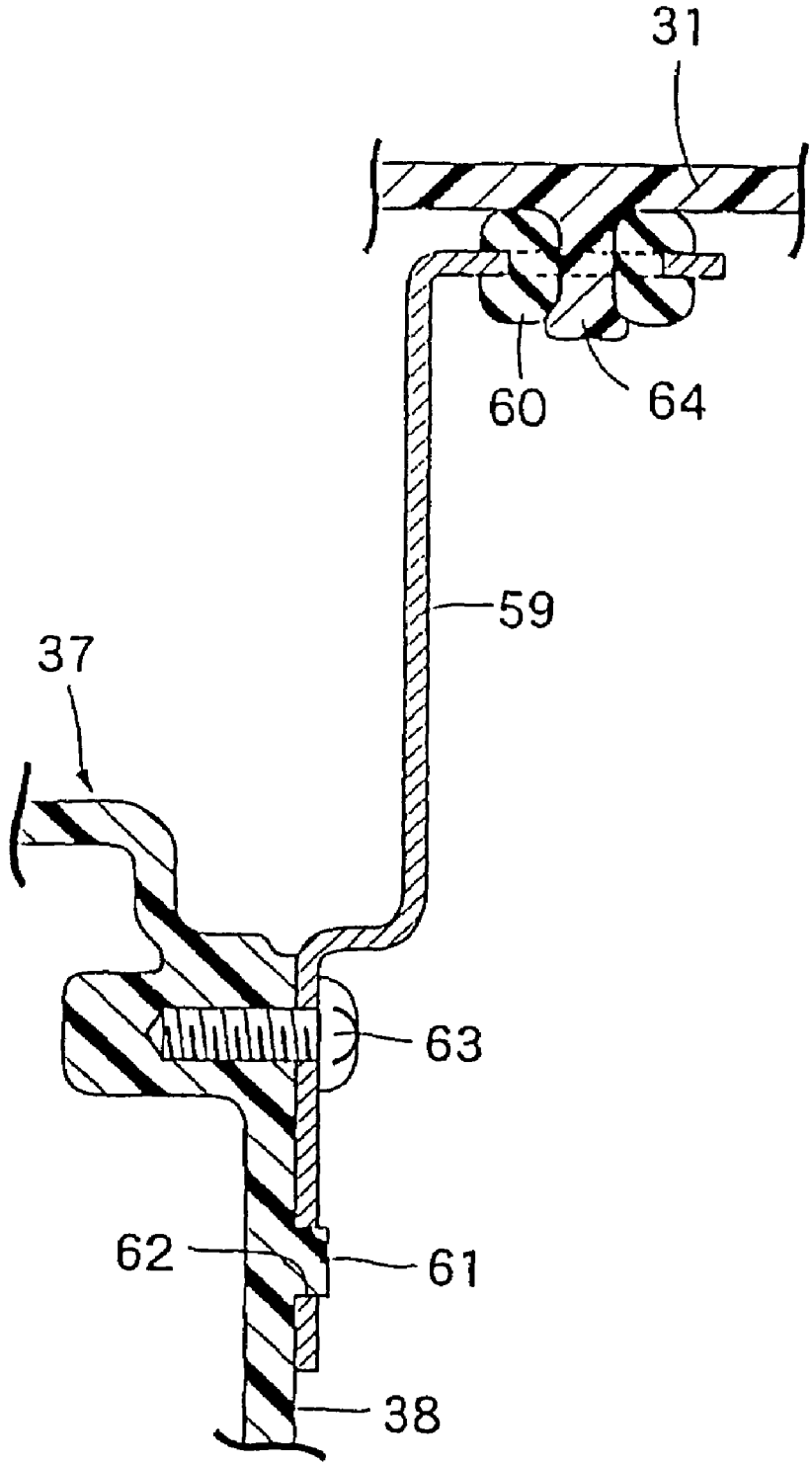
FIG. 7 is an enlarged cross sectional view taken along line 7—7 in FIG. 4.

Referring to FIG. 7 together, the air intake chamber 31 is elastically supported by the inner case half 38 of the cleaner case 37 for the air cleaner 32 through a supporting stay 59 and a grommet 60.

The supporting stay 59 has at its lower end a positioning hole 62 in which a positioning projection 61 projecting from the outer face of the inner case half 38 is fitted. With the positioning projection 61 fit in the positioning hole 62, the lower end of the supporting stay 59 is fastened down to the inner case half 38 by a screw 63.

On the other hand, the supporting stay 59 is at its upper end fitted with a grommet 60. The air intake chamber 31 mounted on the grommet 60 has in its lower part a pair of fitting projections 64 to be fitted in the grommet 60.

A rubber intake tube 65 is connected with the air intake chamber 31. In the area covered by the fuel tank 19, outside air is taken in through the intake tube 65 to the air intake chamber 31.

Next, the operation of this embodiment will now be described. The air cleaner 32 which includes part of the air intake device 30 is arranged so as to partly overlap with the two banks BF, BR of the V-type engine E in a side view seen in the axial direction of the crankshaft 36. The air cleaner 32 is supported by the cleaner supporting units 52F, 52R integrally provided in the cylinder blocks 51F, 51R or cylinder heads 35F, 35R (the cylinder heads 35F, 35R in the case of this embodiment) in the two banks BF, BR.

Accordingly, the air cleaner 32 can be directly supported by the two banks BF, BR of a V-type engine without using a dedicated supporting stay or the like for supporting the air cleaner 32. Thus, a reduction in the number of component parts and the facilitating the assembly work of the air cleaner 32 is permitted. Further, by directly supporting the air cleaner 32 by the cylinder heads 35F, 35R in the two banks BF, BR, it is possible to set a relatively long span between the supporting points on the two banks BF to thus support the air cleaner 32 in a more stable manner.

Since the grommets 54 . . . formed of elastic material are interposed between the cleaner supporting units 52F, 52R and the air cleaner 32, the air cleaner 32 does not resonate in harmony with vibrations of the engine E. Therefore, vibrations of the air cleaner 32 can be reduced.

Moreover, the collars 55 . . . , which run through the grommets 54 . . . fit in the air cleaner 32, are provided at ends thereof with the flanges 55*a* . . . which are located between the cleaner supporting units 52F, 52R and the grommets 54 . . . , and washers 57 . . . are interposed between the enlarged heads 56*a* . . . of bolts 56 . . . , which are inserted into the collars 55 and screwed into the cleaner supporting units 52F, 52R, and the grommets 54. Accordingly, it is possible to suppress the resonance of the air cleaner 32 to securely fix the air cleaner 32 on the two banks BF, BR of the engine E.

Further, since the air cleaner supporting units 52F, 52R, provided in one location in each of the two banks BF, BR, are provided in the cylinder heads 35F, 35R, the air cleaner 32 is supported at a total of three points. More specifically, one point in each of the two banks BF, BR and one point in the connecting part of the air cleaner 32 to the two banks BF, BR. Therefore, the air cleaner 32 can be securely fixed against the vibrations of the engine E.

The embodiment of the present invention has been described hereinabove. However, the present invention should not be limited to the above-described embodiment. Various alternations on the design can be made without departing from the inventions set forth in the appended claims.

In the above described embodiment, for example, one case has been described wherein the air cleaner supporting units 52F, 52R for supporting the air cleaner 32 are provided in the cylinder heads 35F, 35R in the two banks BF, BR. However, the cleaner supporting units may be provided in the cylinder blocks 51F, 51R in the two banks BF, BR. In that case, an air cleaner may be supported in a location downwardly away from the carburetor 34, and the air cleaner may be arranged in a manner that it is vertically elongated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a V-type engine having part of an air intake device including an air cleaner arranged between a pair of banks, an air cleaner supporting structure in a V-type engine, comprising:

an air cleaner arranged at a side of the two banks; and cleaner supporting units for supporting the air cleaner, said cleaner supporting units being integrally provided in any of cylinder blocks and cylinder heads in the two banks, wherein the air cleaner is supported at three points relative to the pair of banks where the first and second points include the cleaner supporting units and the third point includes a connection of the air cleaner to an air intake chamber of the air intake device, wherein an elastic member is interposed between the cleaner supporting units and the air cleaner.

2. The air cleaner supporting structure in a V-type engine according to claim 1, wherein the cleaner supporting units provided in one location in each of the two banks are provided in any of the cylinder blocks and the cylinder heads.

3. The air cleaner supporting structure in a V-type engine according to claim 1, wherein the cleaner supporting units provided in one location in each of the two banks are provided in any of the cylinder blocks and the cylinder heads.

4. In a V-type engine having part of an air intake device including an air cleaner arranged between a pair of banks, an air cleaner supporting structure in a V-type engine, comprising:

an air cleaner arranged at a side of the two banks; and cleaner supporting units for supporting the air cleaner, said cleaner supporting units being integrally provided in any of cylinder blocks and cylinder heads in the two banks, wherein an elastic member is interposed between the cleaner supporting units and the air cleaner, and wherein collars which run through the elastic member fit to the air cleaner to abut on the cleaner supporting units are provided with flanges which abut on the elastic member from the sides of the cleaner supporting units; and washers being interposed between enlarged heads of bolts which are inserted into the collars and screwed into the cleaner supporting units and the elastic member.

5. The air cleaner supporting structure in a V-type engine according to claim 4, wherein the cleaner supporting units provided in one location in each of the two banks are provided in any of the cylinder blocks and the cylinder heads.

6. In a V-type engine comprising:

an air intake device including an air cleaner arranged between a pair of cylinder blocks and cylinder heads of the engine:

an air cleaner supporting structure; and cleaner supporting units for supporting the air cleaner;

wherein said cleaner supporting units are integrally provided relative to either the cylinder blocks or cylinder heads for supporting the air cleaner relative thereto, and wherein the air cleaner is supported at three points relative to the pair of cylinder blocks where the first and second points include the cleaner supporting units and the third point includes a connection of the air cleaner to an air intake chamber of the air intake device, wherein an elastic member is interposed between the cleaner supporting units and the air cleaner.

7. The V-type engine according to claim 6, wherein the cleaner supporting units provided in one location are provided in either of the cylinder blocks and the cylinder heads.

8. The V-type engine according to claim 6, wherein the cleaner supporting units provided in one location are provided in either of the cylinder blocks and the cylinder heads.

9. In a V-type engine comprising:

an air intake device including an air cleaner arranged between a pair of cylinder blocks and cylinder heads of the engine:

an air cleaner supporting structure; and cleaner supporting units for supporting the air cleaner;

wherein said cleaner supporting units are integrally provided relative to either the cylinder blocks or cylinder heads for supporting the air cleaner relative thereto, wherein an elastic member is interposed between the cleaner supporting units and the air cleaner, and wherein collars which run through the elastic member fit to the air cleaner to abut on the cleaner supporting units are provided with flanges which abut on the elastic member from the sides of the cleaner supporting units; and washers being interposed between enlarged heads of bolts which are inserted into the collars and screwed into the cleaner supporting units and the elastic member.

10. The V-type engine according to claim 9, wherein the cleaner supporting units provided in one location are provided in either of the cylinder blocks and the cylinder heads.

11. An air cleaner adapted for use with a V-type engine comprising:

an air intake device including an air cleaner adapted to be arranged between a pair of cylinder blocks and cylinder heads of the engine:

an air cleaner supporting structure; and cleaner supporting units for the cleaner;

wherein said cleaner supporting units are integrally provided relative to either the cylinder blocks or cylinder heads for supporting the air cleaner relative thereto, and wherein the air cleaner is supported at three points relative to the pair of cylinder blocks where the first and second points include the cleaner supporting units and the third point includes a connection of the air cleaner to an air intake chamber of the air intake device, wherein an elastic member is interposed between the cleaner supporting units and the air cleaner.

12. The air cleaner adapted for use with a V-type engine according to claim 11, wherein the cleaner supporting units provided in one location are provided in either of the cylinder blocks and the cylinder heads.

13. The air cleaner adapted for use with a V-type engine according to claim 11, wherein the cleaner supporting units provided in one location are provided in either of the cylinder blocks and the cylinder heads.

14. An air cleaner adapted for use with a V-type engine comprising:

an air intake device including an air cleaner adapted to be arranged between a pair of cylinder blocks and cylinder heads of the engine:

an air cleaner supporting structure; and cleaner supporting units for supporting the air cleaner;

wherein said cleaner supporting units are integrally provided relative to either the cylinder blocks or cylinder heads for supporting the air cleaner relative thereto, wherein an elastic member is interposed between the cleaner supporting units and the air cleaner, wherein collars which run through the elastic member fit to the air cleaner to abut on the cleaner supporting units are provided with flanges which abut on the elastic member from the sides of the cleaner supporting units; and washers being interposed between enlarged heads of bolts which are inserted into the collars and screwed into the cleaner supporting units and the elastic member.

15. The air cleaner adapted for use with a V-type engine according to claim 14, wherein the cleaner supporting units provided in one location are provided in either of the cylinder blocks and the cylinder heads.

* * * * *